US005078814A

United States Patent [19]

Joyce, Jr.

[11] Patent Number: 5,078,814

[45] Date of Patent: Jan. 7, 1992

[54] DYEING INSULATING FILM OF A FLAT CABLE

[75] Inventor: James L. Joyce, Jr., Winston Salem, N.C.

[73] Assignee: AMP Incorporated, Harrisburg, Pa.

[21] Appl. No.: 362,732

[22] Filed: Jun. 7, 1989

Related U.S. Application Data

[62] Division of Ser. No. 609,158, May 11, 1984, abandoned.

[51] Int. Cl.[5] ..... H01B 13/10

[52] U.S. Cl. ..... 156/52; 156/55; 156/240

[58] Field of Search ..... 8/471; 156/52, 238, 156/240, 55; 174/117 F

[56] References Cited

U.S. PATENT DOCUMENTS 3,513,045 5/1970 Emmel et al. ..... 156/55
3,966,396 6/1976 Howes et al. ..... 8/2.5
4,226,594 10/1980 Renaut ..... 8/471
4,351,689 9/1982 Elliot et al. ..... 156/378
4,419,102 12/1983 Gorondy ..... 8/471

*Primary Examiner*—Peter Chin
*Attorney, Agent, or Firm*—Katherine A. Nelson

[57] ABSTRACT

The process for dyeing a continuous polymeric flexible substrate such as a film, uses a strip of transfer paper having sublimable dyes deposited on one surface. The substrate and transfer paper are fed simultaneously into a heat transfer apparatus comprised of a heating means and substrate retaining means. The layers are fed into the apparatus so the uncoated side of the transfer paper is proximate the heating means and substrate is proximate the retaining means. The layers are held against the heating means while sufficient heat is applied to the transfer paper to cause the dye to sublime from the paper and diffuse into the intertices of the substrate.

15 Claims, 2 Drawing Sheets

Fig. 1
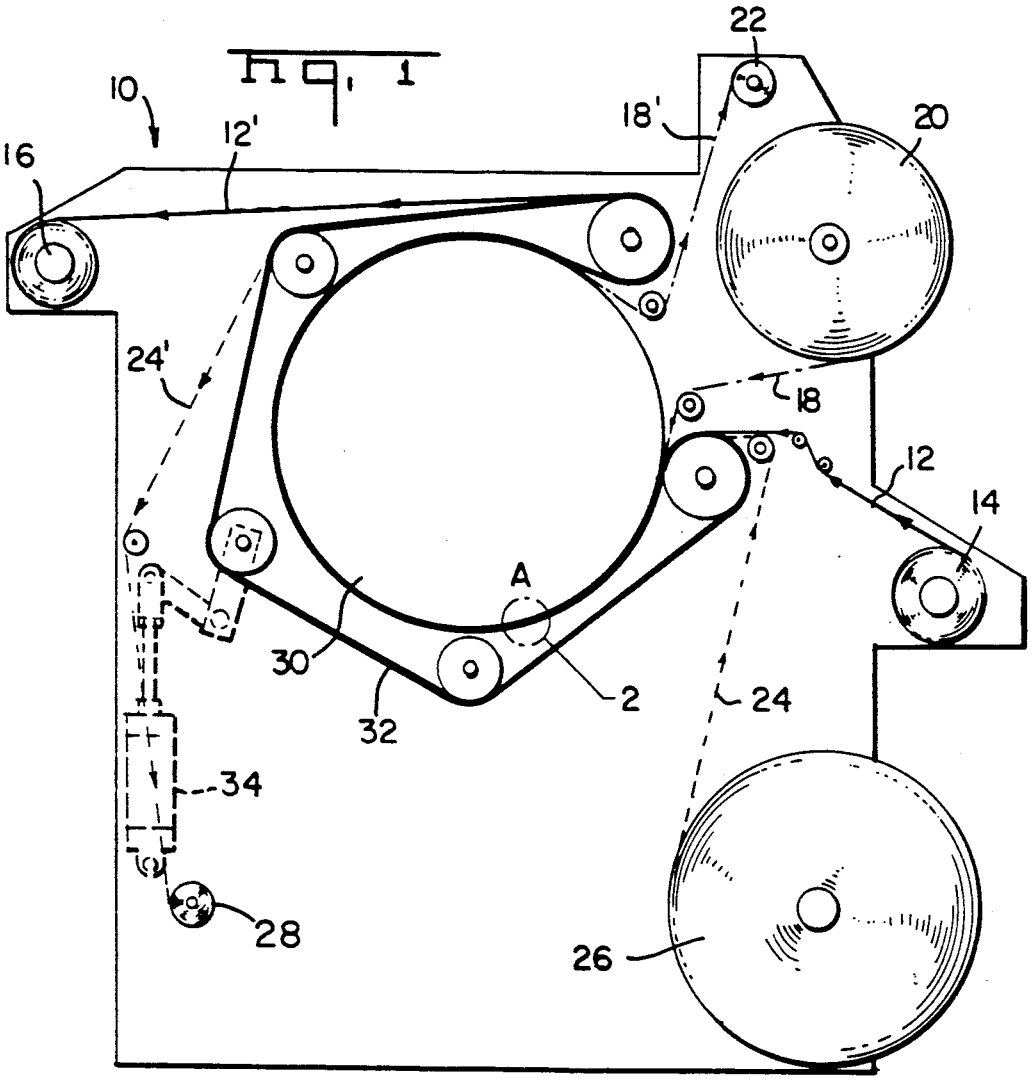
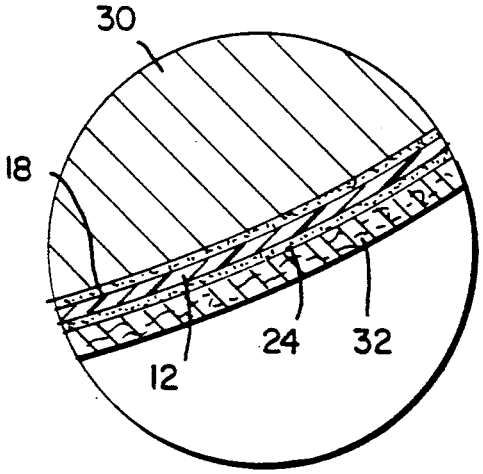
Fig. 2
LEGENDS
| | |
|---|---|
| FILM | ——— |
| TRANS. PAPER | —·—·— |
| BLOT. PAPER | - - - - |

DYEING INSULATING FILM OF A FLAT CABLE

This application is a divisional of application Ser. No. 609,158 filed May 11, 1984 now abandoned.

FIELD OF THE INVENTION

This invention relates to the manufacture of conductor cables and in particular to the manufacture of multiconductor flat flexible cables.

BACKGROUND OF THE INVENTION

There is increasing use of flexible conductor cables in electrical and electronic equipment such as business machines, communication systems and computers. Concomitant with the increased use is the increased need by equipment manufacturers for cable that is color coordinated with the equipment particularly when the cable is visible to anyone viewing or using the equipment. Furthermore, it is desirable that this cable have a matte finish to eliminate glare from any exposed surface.

Conductor cables typically are comprised of a number of longitudinally extended spaced-apart conductor elements encapsulated within an insulating sheath. The conductor elements may be composed of any suitable electroconductive material that exhibits the required qualities of flexibility and strength, such as copper and the like. The insulating material is usually polyester, polyvinyl chloride or other plastic material. The insulating materials used are generally manufactured as a transparent or translucent matte film. Generally these films must be heat stabilized to control shrinkage prior to being made into cable. The cable is made by sandwiching the conductor elements between webs of adhesive coated insulating material and laminating the layers by applying heat and pressure to the sandwich. Typical methods and apparatus for making flexible cables are disclosed in U.S. Pat. Nos. 3,513,045 and 4,351,689.

Standard methods for coloring the plastic film prior to making flexible cable are unsatisfactory. Although it is possible to add pigment to the raw materials prior to extruding or forming the insulating film of material, this method is economically feasible only for very high volume production. Applying color to the surface of the film by means of dipping, spraying, or otherwise coating at least one surface of the film with a pigmented solution is also unsatisfactory. The colored coating is not sufficiently adhered to the surface or heat resistant to remain on the surfaces during the cable manufacturing process, particularly during lamination.

Applying color to the finished cable by dipping, spraying, or other coating means is also unsatisfactory. The different coefficients of expansion of the insulating material and the conductive elements cause the cable layers to separate under the conditions required for the coloring process. Furthermore, a colored coating on the surface of the cable is subject to wear by abrasion and to attack by cleaning solvents.

Flexible cable can also be colored by adding dye to the adhesive layers or by adding a layer of colored insulating material between the outer dielectric web and the conducting elements. While these methods eliminate the problems associated with surface coating, they produce true vivid colors only when used with transparent film. These methods are generally unsatisfactory for coloring translucent film because true vivid colors are unattainable due to the diffusion and refraction properties of the matte film. Furthermore, these methods increase the number of manufacturing steps required to make a finished product.

The process as disclosed herein eliminates the aforementioned problems. The desired color or colors are imparted to the insulating film by means of sublimation dyeing. This process also provides a means to impart a multicolored design and alphanumeric characters as well as solid color to the film.

The process for dyeing a continuous flexible polymeric substrate such as a film, uses a strip of transfer paper having one or more sublimable dyes deposited on one surface. The substrate and transfer paper are fed simultaneously into a heat transfer apparatus comprised of a heating means and a substrate retaining means. The layers are fed into the apparatus so that the uncoated side of the transfer paper is proximate the heating means and the substrate is proximate the substrate retaining means.

The substrate retaining means is used to hold the transfer paper securely between the substrate and the heating means. Sufficient heat is applied to the transfer paper to cause the dye to sublime from the paper and diffuse into the intertices of the substrate as it is swelled during the heating process. The color thus becomes an integral part of the substrate and is not merely a coating. The color remains stable during subsequent processing and is not affected by cleaning solvents or abrasion.

The textile industry has used sublimation dyeing of fabric for a number of years. Apparatus and methods for sublimation dyeing are disclosed in patents such as U.S. Pat. Nos. 2,911,280, 3,966,396, 4,163,642, 4,226,594 and 4,419,102. Sublimation dyeing has also been used to print graphics on keyboards and the like for membrane switches. The printing takes place just prior to final assembly of the keyboard.

It is new, however, to use sublimation dyeing to impart color into a continuous strip of flexible plastic film that is used for manufacturing flexible cable. Further, it is new to use sublimation dyeing as one of the initial steps in a cable manufacturing process. Using the method as disclosed herein also eliminates the necessity of prestabilizing film prior to making the cable. Sublimation dyeing requires a higher temperature than that normally used for stabilizing the material. Thus, the film can be stabilized and colored at the same time. Furthermore, tests show that flexible cable that has been colored by sublimation dyeing in accordance with the herein disclosed process surprisingly and unexpectedly exhibits greater resistance to being peeled apart than cable that has not been colored by this process.

The method can be further understood by referring to the following drawings.

DESCRIPTION OF THE DRAWINGS

FIG. 1 is a schematic view of the apparatus used to transfer color to a continuous flexible polymeric substrate.

FIG. 2 is an enlarged cross-sectional view taken at circle A of FIG. 1.

FIG. 3 is a flow chart giving a schematic method for making flexible conductor cables in accordance with the invention.

PREFERRED EMBODIMENT

Figure 7:
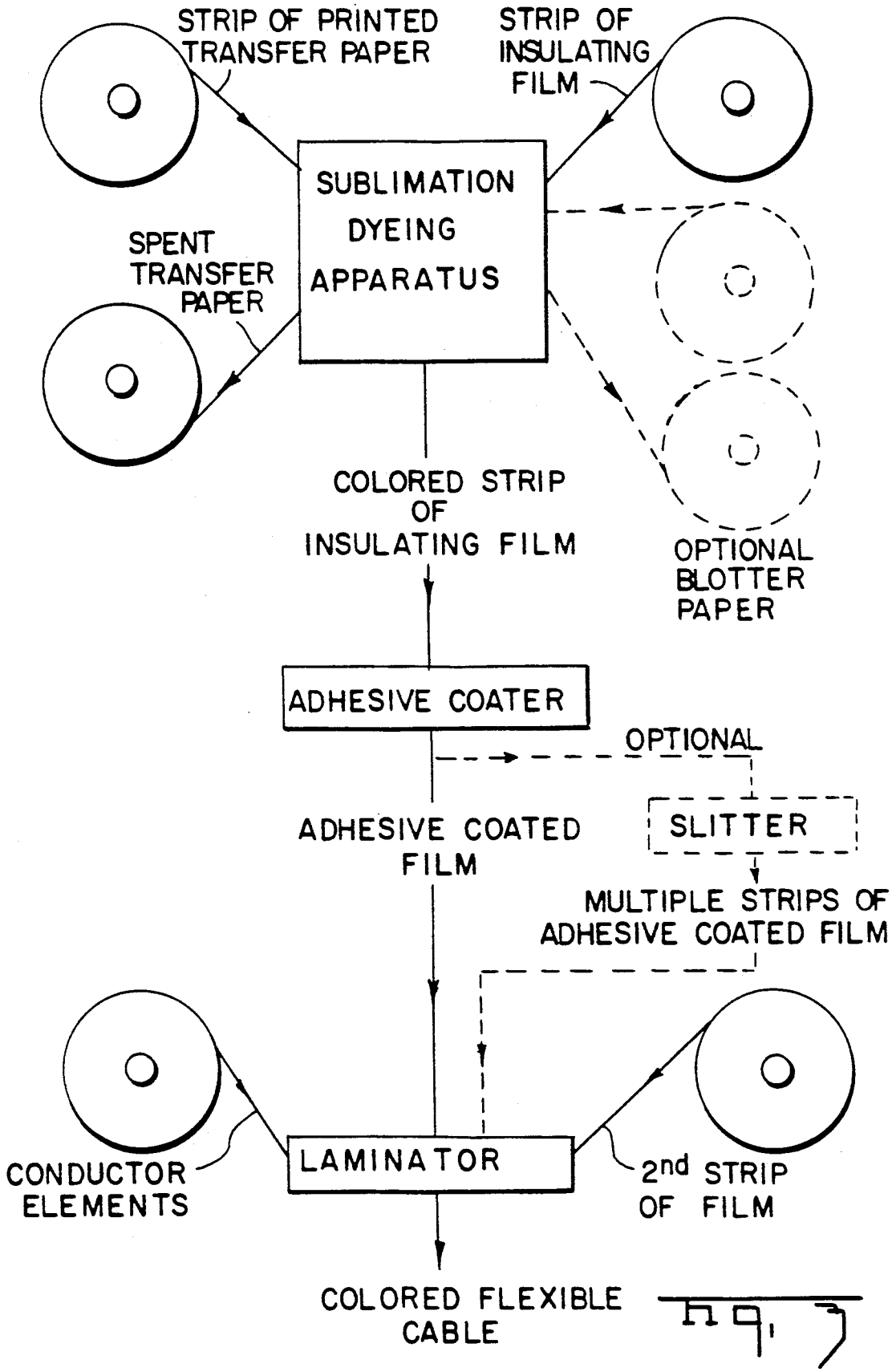

FIG. 1 shows a schematic view of the apparatus used for sublimating dyeing in the disclosed method. Apparatus 10 is comprised of a rotating heatable drum 30 and a continuous belt 32 which is held against the rotating drum 30. A continuous strip of dyed transfer paper 18 and the continuous polymeric film 12 are passed between the rotating drum 30 and belt 32. FIG. 1 also shows the use of blotting paper 24 which may be used between the film 12 and the belt 32 to absorb any excess dye that penetrates through the substrate during the sublimination process. The transfer paper 18, the film 12 and the blotting paper 24 are fed into the apparatus 10 by use of supply reels 20, 14 and 26 respectively. The spent transfer paper 18', the colored film 12' and the spent blotting paper 24' are wound on take-up reels 22, 16 and 28 respectively.

FIG. 2, an enlarged cross-sectional view of a portion of apparatus 10, showing the drum 30 and the belt 32 with the transfer paper 18, the film 12 and the optional blotting paper 24 situated between the drum 30 and the belt 32. During the sublimation dyeing process the belt 32 and the layers of paper 18, 24 and film 12 are held securely against the drum 30 by the tension means 34 as shown in FIG. 1.

FIG. 3 is a schematic representation of the steps used in producing flexible cable in accordance with the disclosed method. The insulating film is dyed by sublimation and coated with an appropriate adhesive. Flexible cable is made by laminating conductor elements between two layers of adhesive coated film. FIG. 3 also shows the use of a slitter which can be used to slit a wide strip of colored film into multiple strips. The film can be slit before or after adhesive is applied.

The transfer paper is made by printing sublimable dye having the desired color and in the desired design onto transfer paper. The dye or ink and transfer paper used are the same as those used by the fabric industry. Paper can be obtained from commercial printing paper suppliers such as Crown Zeller Corp., San Francisco, Calif. 94104. Sublimable dyestuffs are available from manufacturers such as Ciba-Geigy, Ardsley, N.Y., 10502 and Gotham Ink and Color Co. Inc., Long Island City, N.Y., 11101.

The blotting paper, if used, is also standard paper available and commonly used by the fabric industry. Blotting paper is necessary if the apparatus is operated under conditions that cause the dye to be sublimed through the film and onto the belt. The belt is a seamless fiber belt as is used in the fabric industry.

In the preferred embodiment, cable is made from biaxially oriented polyester film. Biaxially oriented film has greater dielectric strength, physical strength and flex life than non-oriented film. In order to have cable that is dimensionally stable the film must be normally stabilized by heating prior to being made into cable. Biaxially oriented film can be obtained from companies such as E. I. DuPont de Nemours & Co. Inc., Wilmington, Del. 19898; ICI Americas Inc., Wilmington, Del. 19897 and American Hoechst Corp., Somerville, N.J. 08876.

The apparatus used is a modification of standard equipment commonly used by the textile industry. Additional heaters and temperature control devices were added so that uniform heat could be maintained throughout the drum. The temperature necessary for dyeing the film depends upon factors such as the dyestuff used, the speed of the drum and the thickness of the paper and film layers. It was found that polyester film dyed best when subjected to temperatures in the range of 350°–450° F. (177°–232° C.). The temperature and time relationship is extremely important. The time required for the dye to sublime and penetrate the plastic film is significantly longer than the time required to dye textile.

Furthermore, the tension on the film must be carefully controlled at all stages of the dyeing process, as the film is fed into the heat transfer apparatus, during the time the film remains in contact with the heat and after the film exits the apparatus. The tension on the continuous belt must be controlled.

The take-up drive was also modified so that a constant tension could be maintained on the film despite the number of layers on the take-up reel. The film begins to cool as soon as it is no longer in contact with the drum. If the tension on the exiting film is not controlled precisely, the film will buckle, wrinkle and have varying degrees of shrinkage across the web as the film cools.

Colored cable was made in accordance with the invention. Continuous strips of transfer paper and film were fed from reels onto the rotating drum. The drum was kept at a constant temperature throughout the dyeing process. By carefully controlling the temperature and speed of the drum the amount of dye sublimed into the film was optimized and the amount of wasted dye was minimized. The majority of the sublimed dye thus became part of the structure of the film. The film was maintained under constant tension as it exited from the drum and was wound onto the take-up reel. Adhesive was then applied to one surface of the colored film. In the preferred embodiment adhesive was applied to the surface of film that was against the transfer paper to ensure that any dye on that surface of the film was encased within the laminated cable. The film was then slit into the desired widths. In the preferred cable embodiment, conductor elements were sandwiched between two layers of the colored film and laminated.

The sublimation method can be used to impart a solid color a plurality of colors, alphanumeric characters, and designs to flexible polymeric substrate. The design on the transfer paper is imparted to the substrate. Thus, otherwise solidly colored substrate when used for electrical cables can be color coded to indicate specific conductors. If color coding is desired this method can be used to color code the film, the cable can be made with one color coded layer of film and one uncoded layer of film.

It is thought that the method of coloring continuous flexible polymeric substrate of the present invention and many of its attendant advantages will be understood from the foregoing description.

It will be apparent that various changes may be made in the heat transfer apparatus, the types of substrate, the design and color imparted to the substrate, and the types of cable and other products made therefrom without parting from the spirit or scope of the invention or sacrificing all its material advantages. The form herein described is merely a preferred or exemplary embodiment thereof.

What is claimed is:

1. A method of making a flat ribbon-like flexible cable at least one side of which includes selected coloration, said cable being comprised of one or more spaced apart, longitudinally extending conductor elements encapsulated between facing inner surfaces of two layers of flexible insulating film comprising the steps of:

providing two longitudinally extending layers of non-porous flexible film each having appropriate dielectric properties;

subliminally dispersing dye from adjacent said inner surface of said film and throughout the thickness of at least one of said layers at least at selected locations thereof thereby defining at least one film layer having selected coloration;

applying adhesive on said inner surface of said at least one of said film layers;

disposing spaced apart, longitudinally extending conductor elements between said facing inner surfaces of said two layers; and adhering said two layers together continuously therealong along facing inner surfaces after said at least one layer has been colored thereby encapsulating said conductor elements;

whereby said coloration is integral with said at least one dielectric layer and is stable during cable handling and in-service cable use, and does not comprise coloring material disposed along an outwardly facing surface nor along a facing inner surface thus being protected by material of said one layer while not interfering with adhesion of facing inner surfaces of said two layers together, and said cable remains assuredly adhered together when subjected to flexing and torque associated with the handling of electrical cable.

2. The method of claim 1 wherein said dye dispersing step includes subjecting said at least one layer to a temperature sufficiently high to stabilize the material of the film.

3. The method of claim 1 wherein said at least one layer having said selected coloration has been colored with a design of one or more colors.

4. The method of claim 1 wherein at least one layer having said selected coloration is a solid color.

5. The method of claim 1 wherein said film layers are matte textured polyester.

6. The method of claim 1 wherein said film layers are translucent.

7. The method of claim 1 wherein said film layers are essentially transparent.

8. The method of claim 1 further including the step of subliminally dispersing dye throughout the thickness of the other one of said film layers at least at selected locations thereof.

9. The method of claim 8 wherein said dye dispersing step includes subjecting said at least one layer to a temperature sufficiently high to stabilize the material of the film.

10. The method of claim 8 wherein at least one of said layers having said selected coloration has been colored with a design of one or more colors.

11. The method of claim 8 wherein at least one of said layers having said selected coloration is a solid color.

12. The method of claim 8 wherein said film layers are matte textured polyester.

13. The method of claim 8 wherein said film layers are translucent.

14. The method of claim 8 wherein said film layers are essentially transparent.

15. The method of claim 8 wherein said dye is subliminally dispersed from adjacent said inner surface of said colored layers.

* * * * *